US010332466B2

(12) United States Patent
Cho et al.

(10) Patent No.: US 10,332,466 B2
(45) Date of Patent: Jun. 25, 2019

(54) METHOD OF DRIVING DISPLAY PANEL AND DISPLAY APPARATUS FOR PERFORMING THE SAME

(71) Applicant: SAMSUNG DISPLAY CO., LTD., Yongin-si, Gyeonggi-do (KR)

(72) Inventors: Se-Hyoung Cho, Hwaseong-si (KR); Hyun Joon Kim, Yongin-si (KR); Cheol-Gon Lee, Suwon-si (KR); Jangmi Kang, Seoul (KR); Mee-Hye Jung, Suwon-si (KR); Jong-Hee Kim, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 116 days.

(21) Appl. No.: 15/135,062

(22) Filed: Apr. 21, 2016

(65) Prior Publication Data

US 2016/0379579 A1 Dec. 29, 2016

(30) Foreign Application Priority Data

Jun. 29, 2015 (KR) ..... 10-2015-0092451

(51) Int. Cl.
*G09G 3/36* (2006.01)
*G09G 3/3275* (2016.01)

(52) U.S. Cl.
CPC ..... *G09G 3/3614* (2013.01); *G09G 3/3275* (2013.01); *G09G 3/3685* (2013.01);
(Continued)

(58) Field of Classification Search
CPC ..... G09G 2230/00; G09G 2310/0254; G09G 2310/0264; G09G 2310/027;
(Continued)

(56) References Cited

U.S. PATENT DOCUMENTS 4,649,383 A * 3/1987 Takeda ..... G09G 3/3648 345/208
6,618,032 B1 * 9/2003 Seino ..... G09G 3/20 345/100
(Continued)

FOREIGN PATENT DOCUMENTS

KR 1020080001179 1/2008
KR 1020080047888 5/2008
(Continued)

OTHER PUBLICATIONS

European Search Report dated Nov. 21, 2016 corresponoing to European Patent Application No. 16177014.

*Primary Examiner* — Michael J Jansen, II
(74) *Attorney, Agent, or Firm* — F. Chau & Associates, LLC

(57) ABSTRACT

A method of driving a display panel includes providing a positive polarity data signal to a first data line during an odd-numbered frame, and providing a negative polarity data signal to the first data line during an even-numbered frame. The positive polarity data signal has a first polarity. The negative polarity data signal has a second polarity. Output timing of the positive polarity data signal is different from output timing of the negative polarity data signal.

24 Claims, 7 Drawing Sheets

(52) U.S. Cl.
CPC ... *G09G 2230/00* (2013.01); *G09G 2310/027* (2013.01); *G09G 2310/0254* (2013.01); *G09G 2310/0264* (2013.01); *G09G 2310/08* (2013.01); *G09G 2320/0223* (2013.01); *G09G 2320/0252* (2013.01)

(58) Field of Classification Search
CPC ..... G09G 2310/08; G09G 2320/0223; G09G 2320/0252; G09G 3/3275; G09G 3/3614; G09G 3/3685; G09G 2310/06
See application file for complete search history.

(56) References Cited

U.S. PATENT DOCUMENTS 6,980,190 B2 * 12/2005 Ueda ..... G09G 3/3614 345/100
7,336,253 B2 * 2/2008 Kim ..... G09G 3/3611 345/87
7,375,707 B1 * 5/2008 Lee ..... G09G 3/3648 345/89
7,864,150 B2 * 1/2011 Shih ..... G09G 3/3659 345/53
8,330,698 B2 * 12/2012 Son ..... G09G 3/3648 345/209
8,614,701 B2 * 12/2013 Watanabe ..... G09G 3/3648 345/100
8,902,144 B2 * 12/2014 Umezaki ..... G09G 3/3413 345/100
9,268,185 B2 * 2/2016 Kimura ..... G09G 3/20
9,898,981 B2 * 2/2018 Lee ..... G09G 3/3648
2002/0084972 A1 * 7/2002 Kim ..... G09G 3/3611 345/99
2003/0132903 A1 * 7/2003 Ueda ..... G09G 3/3614 345/87
2005/0017936 A1 * 1/2005 Chen ..... G09G 3/3611 345/87
2005/0219187 A1 * 10/2005 Shih ..... G09G 3/3659 345/94
2007/0046610 A1 * 3/2007 Okuzono ..... G09G 3/3614 345/96
2008/0030490 A1 * 2/2008 Son ..... G09G 3/3648 345/205
2010/0134396 A1 * 6/2010 Umezaki ..... G09G 3/3413 345/92
2012/0120044 A1 * 5/2012 Mizunaga ..... G09G 3/3614 345/211
2012/0287100 A1 * 11/2012 Woo ..... G09G 3/3651 345/209
2013/0201174 A1 * 8/2013 Pyun ..... G09G 3/3607 345/213
2014/0218347 A1 * 8/2014 Lee ..... G02F 1/136286 345/211
2014/0333595 A1 * 11/2014 Cho ..... G09G 3/3614 345/209
2015/0042918 A1 * 2/2015 Kimura ..... G09G 3/20 349/43
2016/0104443 A1 * 4/2016 Lee ..... G09G 3/3648 345/209
2016/0365046 A1 * 12/2016 Chen ..... G02F 1/1362

FOREIGN PATENT DOCUMENTS

KR 1020090066528 6/2009
KR 1020120042293 5/2012
KR 1020120134238 12/2012
KR 1020140098892 8/2014

* cited by examiner

METHOD OF DRIVING DISPLAY PANEL AND DISPLAY APPARATUS FOR PERFORMING THE SAME

CROSS-REFERENCE TO RELATED APPLICATION

This application claims priority under 35 U.S.C. § 119 to Korean Patent Application No. 10-2015-0092451, filed on Jun. 29, 2015, the disclosure of which is incorporated by reference in its entirety herein.

BACKGROUND

1. Technical Field

Exemplary embodiments of the inventive concept relate to a method of driving a display panel and a display apparatus for performing the method.

2. Discussion of Related Art

A liquid crystal display (LCD) apparatus is typically thin, light and uses very little power consumption. Thus the LCD apparatus is used in monitors, laptop computers and cellular phones. The LCD apparatus includes an LCD panel displaying images using a light transmittance of a liquid crystal, a backlight assembly disposed under the LCD panel that provides light to the LCD panel and a driving circuit driving the LCD panel.

The liquid display panel includes an array substrate having gate lines, data lines, pixels and an opposing substrate, which has a common electrode. A liquid crystal layer is disposed between the array substrate and the opposing substrate. The driving circuit includes a gate driving part that drives the gate lines with gate signals and a data driving part that drives the data lines with data signals.

However, a RC time delay of the gate signal transferred through a gate line and the data signal transferred through a data line occurs when a liquid display panel has a large size. For example, the RC time delay of the gate signal occurs in an area far away from the gate driving part outputting the gate signal the gate driving part. The gate signal controls a charging period during which the data signal is charged in the pixel so that a charging ratio may be decreased by the RC time delay of the gate signal. The RC time delay may reduce the quality of the display panel. For example, luminance lowering, color mixing, and ghosting may be caused by the RC time delay.

SUMMARY

At least one embodiment of the inventive concept provides a method of driving a display panel that is capable of decreasing a data charging ratio difference by a delay of a gate signal.

At least one embodiment of the inventive concept provides a display apparatus that performs a method of driving the display panel.

According to an exemplary embodiment of the inventive concept, a method of driving a display panel includes providing a positive polarity data signal to a first data line during an odd-numbered frame, and providing a negative polarity data signal to the first data line during an even-numbered frame. The positive polarity data signal has a first polarity. The negative polarity data signal has a second polarity. Output timing of the positive polarity data signal is different from output timing of the negative polarity data signal.

In an exemplary embodiment, the output timing of the positive polarity data signal precedes the output timing of the negative polarity data signal by a predetermined time period.

In an exemplary embodiment, during the odd-numbered frame, a negative polarity data signal having the second polarity is provided to a second data line which is adjacent to the first data line, and during the even-numbered frame, a positive polarity data signal having the first polarity is provided to the second data line.

In an exemplary embodiment, the predetermined time period is shorter than one horizontal period.

In an example embodiment, the predetermined time period is set to be proportional to a RC delay time period of a gate signal.

In an exemplary embodiment, the predetermined time period is about 30% of an RC delay time period of a gate signal.

In an exemplary embodiment, the method further includes generating a first clock signal, and generating a second clock signal, where the first clock signal and the second clock signal have rising times different from each other.

In an exemplary embodiment, during the odd-numbered frame, the first clock signal controls the output timing of data signal which is provided to the first data line, and during the even-numbered frame, the second clock signal controls the output timing of a data signal which is provided to the second data line.

In an exemplary embodiment, the first clock signal controls the output timing of the positive polarity data signal, and the second clock signal controls the output timing of the negative polarity data signal.

According to an exemplary embodiment of the inventive concept, a display apparatus includes a display panel including a plurality of data lines, a plurality of gate lines and a plurality of pixels, a data driver configured to provide a positive polarity data signal and a negative polarity data signal to the display panel. Each of the pixels includes a switching element electrically connected to a corresponding one of the gate lines and a corresponding one of the data lines. The positive polarity data signal has a first polarity. The negative polarity data signal has a second polarity. Output timing of the positive polarity data signal is different from output timing of the negative polarity data.

In an exemplary embodiment, the output timing of the positive polarity data signal precedes the output timing of the negative polarity data signal by a predetermined time period.

In an exemplary embodiment, the positive polarity data signal is provided to a first data line among the data lines during an odd-numbered frame, and the negative polarity data signal is provided to the first data line during an even-numbered frame.

In an exemplary embodiment, the data driver is configured to control output timing of the first data line using a first clock signal, and configured to control output timing of a second data line using a second clock signal.

In an exemplary embodiment, the data driver is configured to control output timing of the positive polarity data signal using a first clock signal, and configured to control output timing of a negative polarity data signal using a second clock signal.

In an exemplary embodiment, a second negative polarity data signal having the second polarity is provided to a second data line among the data lines during an odd-numbered frame, and a second positive polarity data signal having the first polarity is provided to the second data line during an even-numbered frame.

In an exemplary embodiment, the data driver is configured to control output timing of the first data line using a first clock signal, and configured to control output timing of a second data line using a second clock signal, where the second clock signal has a rising edge different from that of the first clock signal.

In an example embodiment, the predetermined time period is shorter than one horizontal period.

In an exemplary embodiment, the predetermined time period is set to be proportional to an RC delay time period of a gate signal.

In an exemplary embodiment, the predetermined time period is about 30% of an RC delay time period of a gate signal.

In an exemplary embodiment, during one frame, data signals having a same polarity are provided to a same data line.

According to an exemplary embodiment of the inventive concept, a driving apparatus for a display panel of a display apparatus includes a controller circuit configured to output a first clock signal with a first timing and a second clock signal with a second different timing; and a data driving circuit configured to provide a positive polarity data signal having a first polarity to a first data line of the display panel in response to the first clock signal, and provide a negative polarity data signal having a second polarity to a second adjacent data line of the display panel in response to the second clock signal.

In an embodiment, pulses of the second clock signal follow respective pulses of the first clock signal without overlap during an odd-numbered frame period, and pulses of the second clock signal precede respective pulses of the first clock signal without overlap during an even-numbered frame period.

In an embodiment, wherein pulses of the second clock signal follow respective pulses of the first clock signal with overlap during an odd-numbered frame period, and pulses of the second clock signal precede respective pulses of the first clock signal with overlap during an even-numbered frame period, In an embodiment, wherein pulses of the second clock signal follow respective pulses of the first clock signal without overlap.

According to exemplary embodiments of the present inventive concept, output timing of a positive polarity data signal and output timing of a negative polarity data signal may be different each other, so that display quality degradation due to a charging ratio difference between positive and negative polarities according to an RC delay of a scan signal may be reduced.

BRIEF DESCRIPTION OF THE DRAWINGS

The inventive concept will become more apparent by describing in detail exemplary embodiments thereof with reference to the accompanying drawings, in which.

DETAILED DESCRIPTION OF THE EXEMPLARY EMBODIMENTS

Hereinafter, exemplary embodiments of the inventive concept will be explained in detail with reference to the accompanying drawings.

Figure 1:
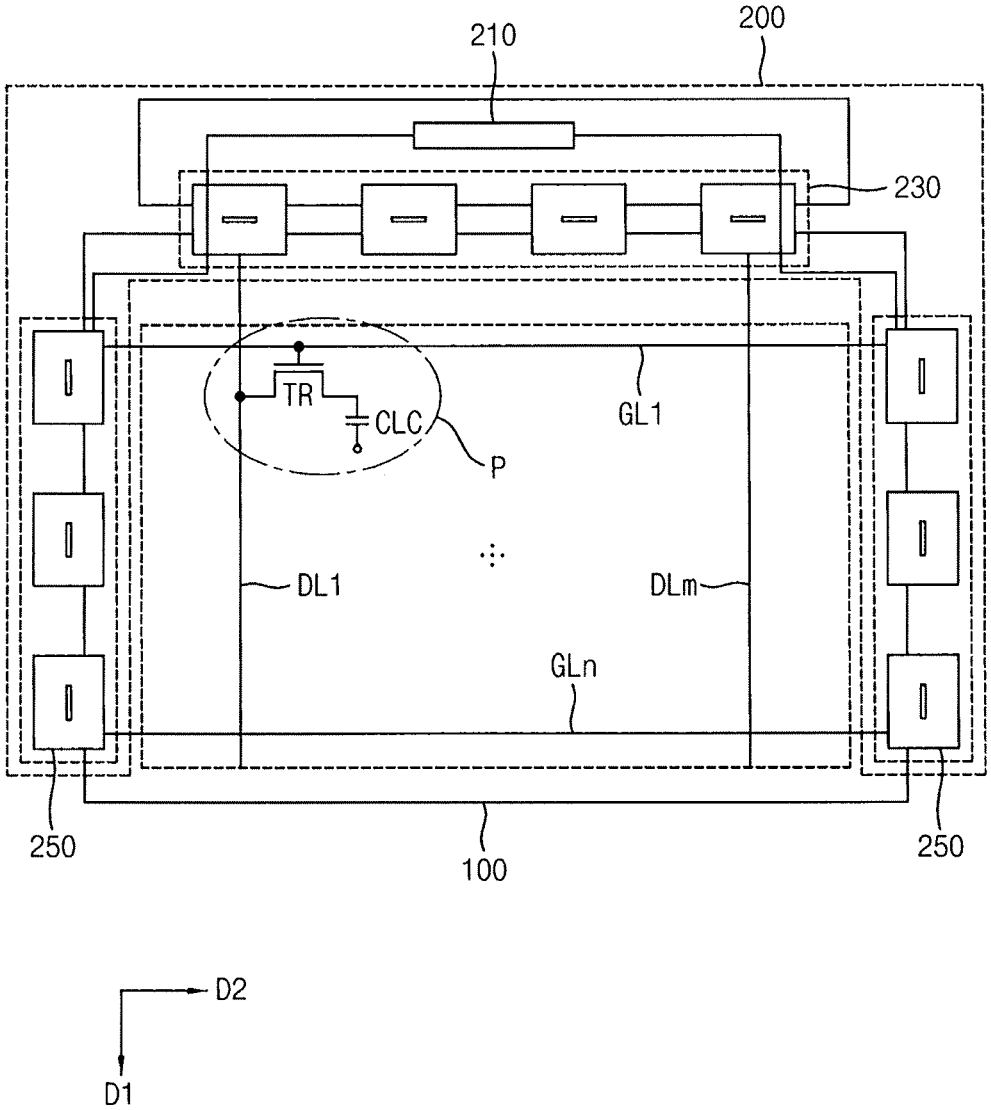
FIG. 1 is a plan view illustrating a display panel according to an exemplary embodiment of the inventive concept.
Figure 2:
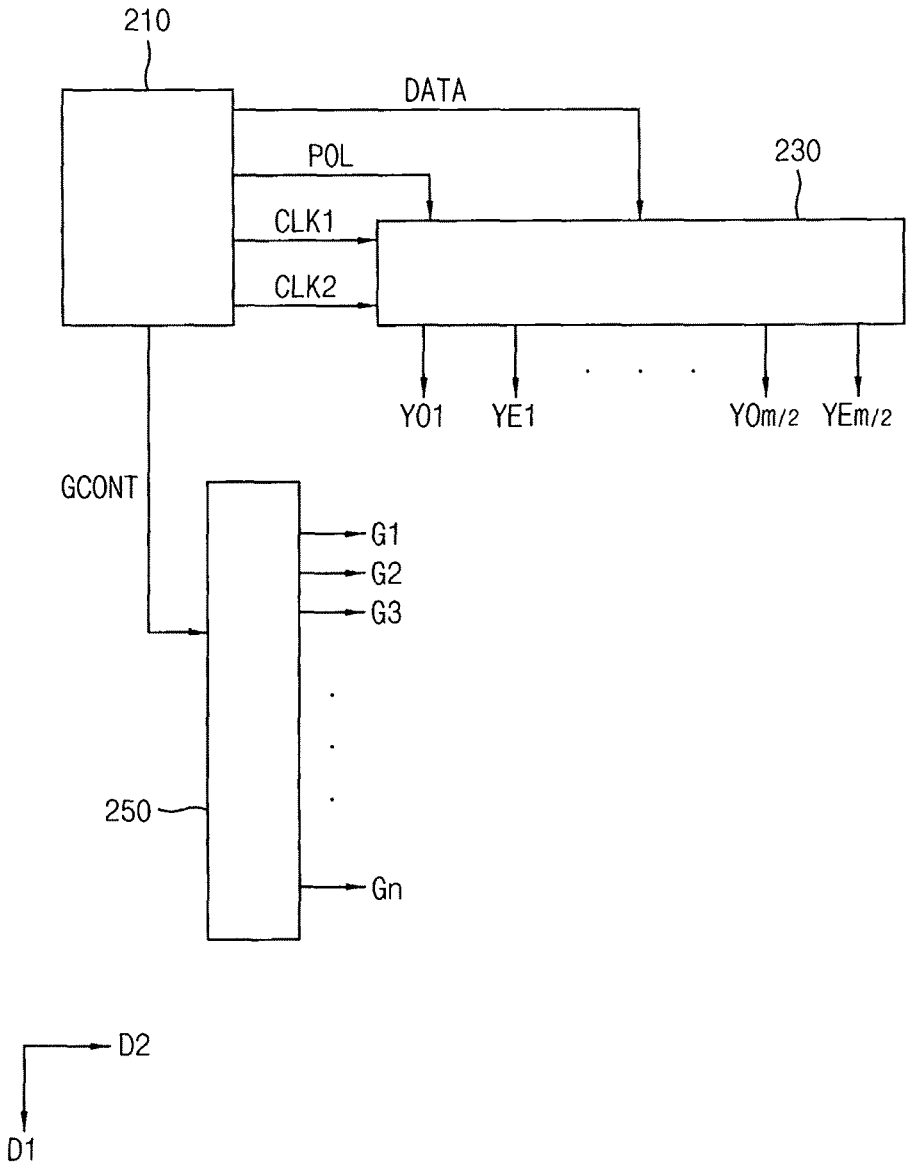
FIG. 2 is a block diagram illustrating a display driving part of FIG. 1 according to an exemplary embodiment of the inventive concept.

FIG. 1 is a plan view illustrating a display panel according to an exemplary embodiment of the inventive concept. FIG. 2 is a block diagram illustrating a display driving part of FIG. 1.

Referring to FIGS. 1 and 2, the display panel includes a display panel 100 and a display driving part 200 (e.g., a driver or a driver circuit).

The display panel 100 includes a plurality of data lines DL1, . . . , DLm, a plurality of gate lines GL1, . . . , GLn and a plurality of pixels P. Each of the pixels P includes a switching element TR connected to a data line DL1 and a gate line GL1 and a liquid crystal capacitor CLC connected to the switching element TR.

The pixels P are arranged as a matrix type which includes a plurality of pixel rows and a plurality of pixel columns. The data lines DL1, . . . , DLm are extended in a first direction D1, that is a column direction, and arranged in a second direction D2, that is, a row direction, crossing the first direction D1. Each of the data lines is electrically connected to the pixels of a same pixel column arranged in the first direction D1.

The gate lines GL1, . . . , GLn are extended in the second direction D2 and arranged in the first direction D1. Each of the gate lines is electrically connected to the pixels of a same pixel row arranged in the second direction D2.

The display driving part 200 includes a control circuit part 210 (e.g., a controller or a control circuit), a data driving part 230 (e.g., a data/source driver or a data/source driver circuit) and a gate driving part 250 (e.g., a gate/scan driver or gate/scan driver circuit). The control circuit part 210 controls operation of the data driving part 230. In an embodiment the control circuit part 210 is incorporated within a timing controller.

For example, the control circuit part 210 provides the data driving part 230 with at least one of a data signal DATA and a data control signal. In an embodiment, the data signal DATA includes a color data signal and may be a signal corrected using compensation algorithms for improving a response time of liquid crystal and for compensating a white.

In an embodiment, the data control signal includes a first clock signal CLK1, a second clock signal CLK2 and a polarity inversion signal POL.

The data driving part 230 provides data signals YO1, YE1, . . . , YOm/2, YEm/2 to the data lines DL1, . . . , DLm according to a column inversion mode. The data driving part 230 outputs the data signals YO1, YE1, . . . , YOm/2, YEm/2 based on the first clock signal CLK1, the second clock signal CLK2 and the polarity inversion signal POL.

For example, the data driving part 230 may provide data signals having polarities different from each other to adjacent data lines. In an embodiment, the data signals have different polarities each one frame period. In an embodiment, one frame period is a period during which data signals are output an entire group of pixel rows (e.g., all odd pixel rows or all even pixel rows). Thus, odd-numbered data signals YO1, . . . , YOm/2 may be provided to odd-numbered data lines (e.g., D1, D3, etc.) and even-numbered data signal YE1, . . . , YEm/2 may be provided to even-numbered data lines (e.g., D2, D4, etc.). The odd-numbered data signals YO1, . . . , YOm/2 may have first polarity or second polarity with respect to reference signal according to the polarity inversion signal POL. The even-numbered data signals YE1, . . . , YEm/2 may have first polarity or second polarity with respect to the reference signal according to the polarity inversion signal POL. The polarity inversion signal POL may have different value in every frame. For example, the voltage level of the polarity inversion signal POL may toggle between first and a second different logic levels each next frame period. Accordingly, the display panel 100 may be driven by a column inversion mode and a frame inversion mode.

In an embodiment, the control circuit part 210 controls the gate driving part 250.

In an embodiment, the control circuit part 210 provides a gate control signal GCONT to the gate driving part 250.

The gate driving part 250 may include a plurality of shift resistors which generate gate signals G1, G2, G3, . . . , Gn. The gate driving part 250 receives the gate control signal GCONT from the control circuit part 210. The gate control signal GCONT may include a gate on signal, a gate off signal, a vertical start signal, a gate clock signal, an output enable signal (e.g., refer to OE of FIG. 4B).

The vertical start signal may control a start timing at which an operation of the gate driving part 250 is started. The gate clock signal may control a rising timing, that is, a start timing of a rising period during which each of the gate signals G1, . . . , Gn rises from a low level to a high level. The output enable control signal OE may control a falling timing, that is, a start timing of a falling period during which each of the gate signals G1, . . . , Gn falls from the high level to the low level.

The gate on signal may control a gate-on level (or voltage) of the gate signals G1, . . . , Gn and the gate-off signal (or voltage) may control a gate-off level of the gate signals G1, . . . , Gn. In an embodiment, the level of the gate-on signal differs from the level of the gate-off signal.

Figure 3:
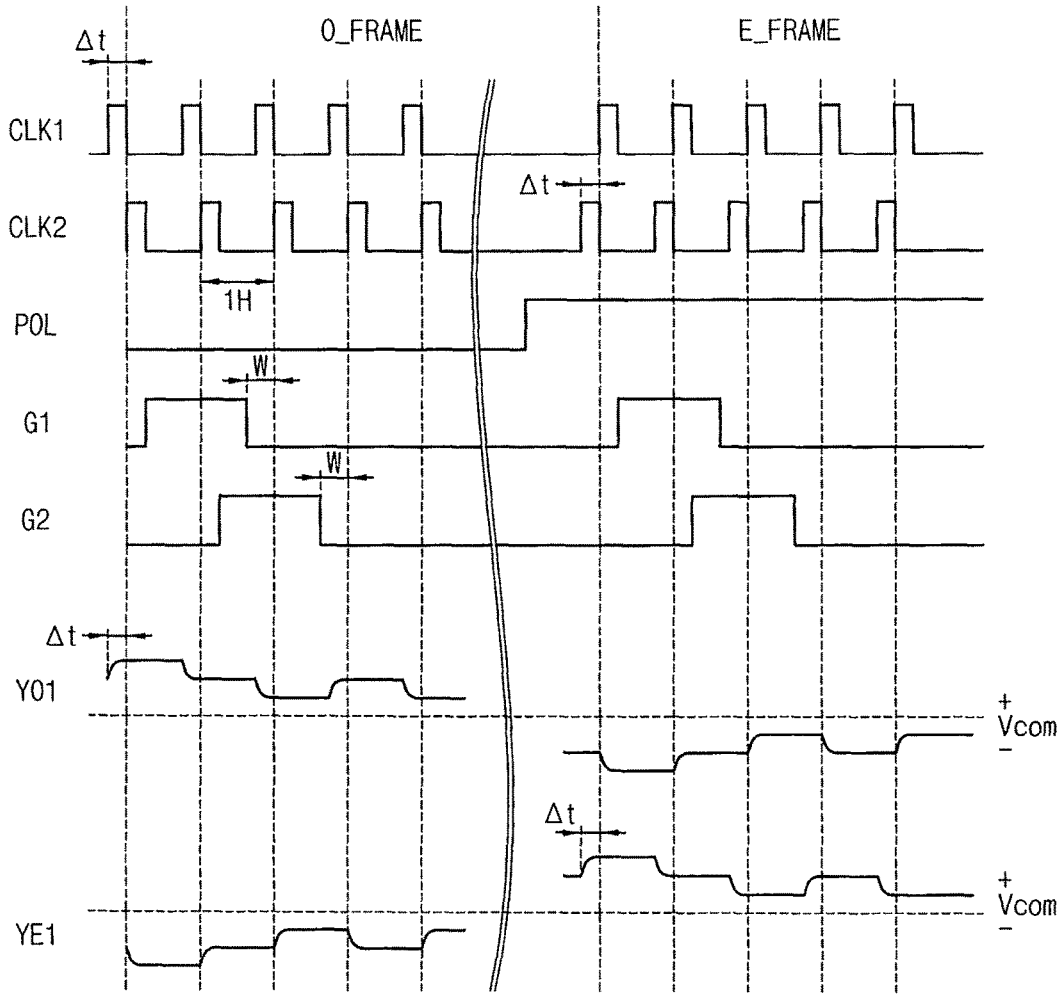
FIG. 3 is a waveform diagram illustrating signals of the display driving part of FIG. 2.

FIG. 3 is a waveform diagram illustrating signals of the display driving part of FIG. 2.

Referring to FIGS. 2 and 3, a data driving part 230 receives a first clock signal CLK1, a second clock signal CLK2 and a polarity inversion signal POL from a control circuit part 210, and outputs the data signals YO1, YE1. Thus, odd-numbered data signals YO1, . . . , YOm/2 may be provided to odd-numbered data lines, and even-numbered data signals YE1, . . . , YEm/2 may be provided to even-numbered data lines. A gate driving part 250 receives the gate control signal GCONT from the control circuit part 210 and outputs gate signals G1, G2. The display driving part 200 may be driven by a column inversion mode and a frame inversion mode.

For convenience of explanation, only gate signals G1, G2 for first and second gate lines, and odd-numbered data signal YO1 and even-numbered data signal YE1 will be explained.

The first clock signal CLK1 may control a rising time, that is, a start timing of a rising period during which each the odd-numbered data signal YO1 rises from a low level to a high level. Thus, each of the data values that is included in the odd-numbered data signal YO1 may be outputted with reference to the first clock signal CLK1 every one horizontal period 1H.

In addition, although the data values are changed with reference to a rising edge of the first clock signal CLK1, the inventive concept is not limited thereto. For example, the data values of the odd-numbered data signal YO1 in every horizontal period 1H may be outputted in synchronization with a rising edge or a falling edge of the first clock signal CLK1.

The second clock signal CLK2 may control a rising time, that is, a start timing of a rising period during which the even-numbered data signal YE1 rises from a low level to a high level. Thus, each of the data values which is included in the even-numbered data signal YE1 may be outputted with reference to the second clock signal CLK2 every one horizontal period 1H.

In addition, although the data values are changed with reference to a rising edge of the second clock signal CLK2, the inventive concept is not limited thereto. For example, the data values of the even-numbered data signal YE1 every one horizontal period 1H may be outputted in synchronization with a rising edge or a falling edge of the second clock signal CLK2.

During an odd-numbered frame period O_FRAME, the first clock signal CLK1 precedes the second clock signal CLK2 by a predetermined time period Δt. During an even-numbered frame period E_FRAME, the second clock signal CLK2 precedes the first clock signal CLK1 by a predetermined time period Δt. In an embodiment, during part of the odd-numbered frame period O_FRAME, a pulse of the first clock signal CLK1 precedes a pulse of the second clock signal CLK2 without overlapping. In an embodiment, during part of the even-numbered frame period E_FRAME, a pulse of the second clock signal CLK2 precedes a pulse of the first clock signal CLK1 without overlapping. In an embodiment, first pulses of the first clock signal CLK1 during the odd-numbered frame period O_FRAME are out of phase with first pulses of the second clock signal CLK2 during the odd-numbered frame period O_FRAME by a first angle. In an embodiment, second pulses of the first clock signal CLK1 during the even-numbered frame period E_FRAME are out of phase with second pulses of the second clock signal CLK2 during the even-numbered frame period E_FRAME by a second angle.

A clock signal (first clock signal CLK1 or second clock signal CLK2) which is synchronized to the data value which has a positive polarity may precede a clock signal (second clock signal CLK2 or first clock signal CLK1) which is synchronized to the data value which has a negative polarity by the predetermined time Δt. Thus, a data signal which has a positive polarity value may be outputted before a data signal which has a negative polarity value by the predetermined time Δt. In an embodiment, the predetermined time Δt has a duration that is the same as the duration of one of the pulses of the clock signals.

In an embodiment, the polarity inversion signal POL reverses the data signals YO1, YE1. For example, the polarity inversion signal POL may have a low level during the odd-numbered frame period O_FRAME, and have a high level during even-numbered frame period E_FRAME. Accordingly, the odd-numbered data signal YO1 has data values which have different polarities in the odd-numbered frame period O_FRAME and the even-numbered frame period E_FRAME. The even-numbered data signal YE1 has data values which have different polarities in the odd-numbered frame period O_FRAME and the even-numbered frame period E_FRAME.

The gate driving part 250 may generate the gate signals G1, G2 which have a gate-on level and a gate-off level using a gate-on signal having a high level and a gate-off signal having a low level. Each of the gate signals G1, G2 may be provided to each of the first and second gate lines first during two horizontal periods 2H, in order. The falling timing of gate signals G1, G2 may be set by a control period W of an output enable control signal (e.g., refer to OE of FIG. 4B).

The odd-numbered data signal YO1 has a positive (+) data value with reference to a reference signal VCOM during the odd-numbered frame period O_FRAME. The odd-numbered data signal YO1 has a negative (−) data value with reference to the reference signal VCOM during the even-numbered frame period E_FRAME.

The even-numbered data signal YE1 has a negative (−) data value with reference to the reference signal VCOM during the odd-numbered frame period O_FRAME. The even-numbered data signal YE1 has a positive (+) data value with reference to the reference signal VCOM during the even-numbered frame period E_FRAME.

According to the present exemplary embodiment, a data signal having the positive data value precedes the data signal having the negative data value by the predetermined time Δt, so that a positive data charging time is longer than a negative data charging time by the predetermined time Δt. Thus, display quality degradation due to a charging ratio difference according to polarities may be reduced.

Figure 4A:
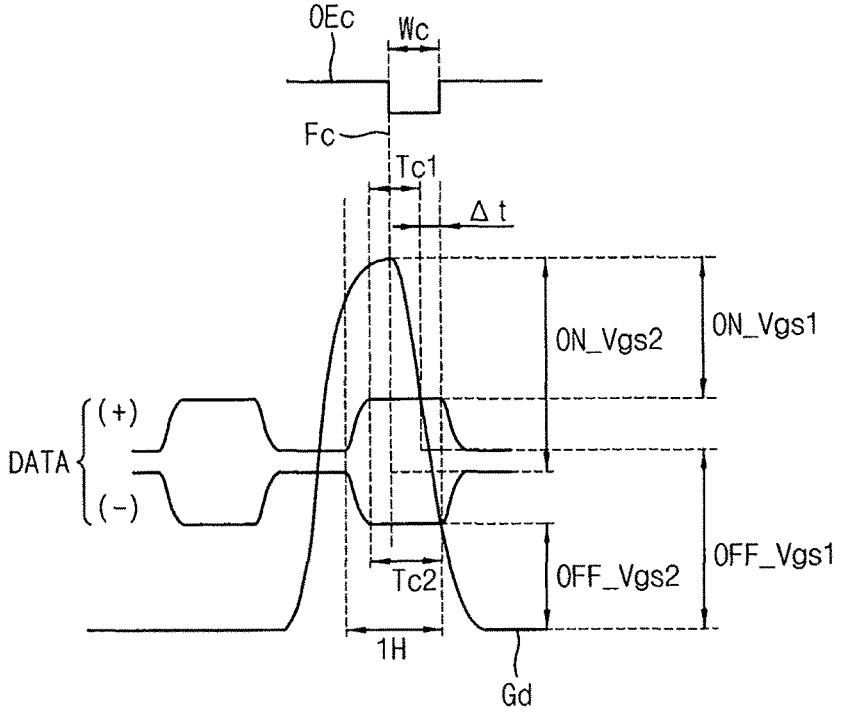
FIGS. 4A and 4B are waveform diagrams illustrating a data charging ratio according to a gate signal and a data signal.
Figure 4B:
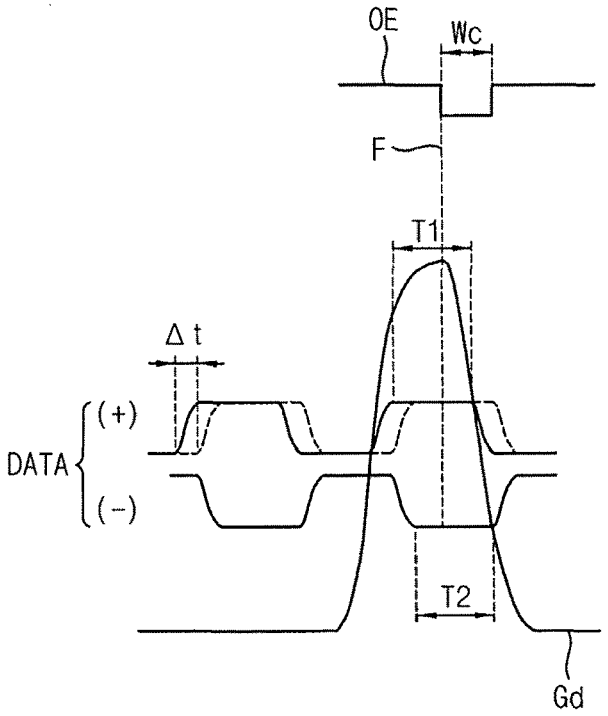

FIGS. 4A and 4B are waveform diagrams illustrating a data charging ratio according to a gate signal and a data signal.

FIG. 4A is a waveform diagram illustrating a data charging ratio by a gate signal according to a comparative embodiment. FIG. 4B is a waveform diagram illustrating a data charging ratio by a gate signal according to an exemplary embodiment of the inventive concept.

Generally, the output-enable control signal controls the falling timing of the gate signal to prevent the data signals applied to adjacent pixel rows from mixing. The RC delay time period of the gate signal is increased in an area far away from the gate driving part. For example, when the gate driving part is respectively disposed in areas adjacent to both ends of the gate line, such as a dual-bank structure, the RC delay time period of the gate signal is largest in a central area of the display panel in a horizontal direction. Therefore, the output-enable control signal is determined depending on a delay condition of the central area, in which the RC delay time period of the gate signal is largest.

Referring to FIG. 4A, according to the comparative embodiment, the output-enable control signal OEc has a control period Wc which controls a falling timing Fc of a gate signal Gd. The control period Wc is determined depending on the negative polarity data signal (−) which is a worst case to prevent the data signals of adjacent pixel rows from mixing.

Thus, the positive polarity data signal (+) has a first charging time period Tc1 and the negative polarity data signal (−) has a second charging time period Tc2, by the gate signal Gd having the falling timing which is determined by the control period We of the output-enable control signal OEc. The second charging time period Tc2 is greater than the first charging time Tc1 by Δt.

In other words, a gate/source voltage ON_Vgs1 of the positive polarity (+) is less than a gate/source voltage ON_Vgs2 of the negative polarity (−). When the gate/source voltage Vgs is increased, an output current Id of the transistor is increased. Thus, a data charging ratio of the negative polarity (−) is more than a data charging ratio of the positive polarity (+). As described above, a charging ratio difference between the positive polarity (+) and the negative polarity (−) causes a lower-quality display with a flicker or an after-image.

In addition, the gate/source voltage OFF_Vgs1 of the positive polarity (+) is different from the gate/source voltage OFF_Vgs2 of the negative polarity (−) so that a turn-off period of the positive polarity (+) is different from that of the negative polarity (−), in a voltage-current curve of a transistor. Therefore, an off-leakage current of the positive polarity (+) is different from an off-leakage current of the negative polarity (−), so that an off-leakage current difference causes a lower-quality display with a flicker or an after-image.

Referring to FIG. 4B, according to an exemplary embodiment of the inventive concept, the positive polarity data signal (+) precedes the negative polarity data signal (−) by a predetermined time Δt.

The output-enable control signal OE has a control period W which controls a falling timing F of a gate signal Gd. The control period W is determined depending on the negative polarity data signal (−) which is a worst case to prevent the data signals of adjacent pixel rows from mixing.

Accordingly, the positive polarity data signal (+) has a first charging time period T1, and the negative polarity data signal (−) has a second charging time period T2, by the gate signal Gd which corresponds to the control period of the output-enable control signal OE. Since the positive polarity data signal (+) precedes the negative polarity data signal (−) by the predetermined time Δt, the positive polarity data signal (+) has a charging time that is longer than that of FIG. 4A by the predetermined time Δt. Thus, display quality degradation due to charging ratio differences according to polarities may be reduced.

Figure 5:
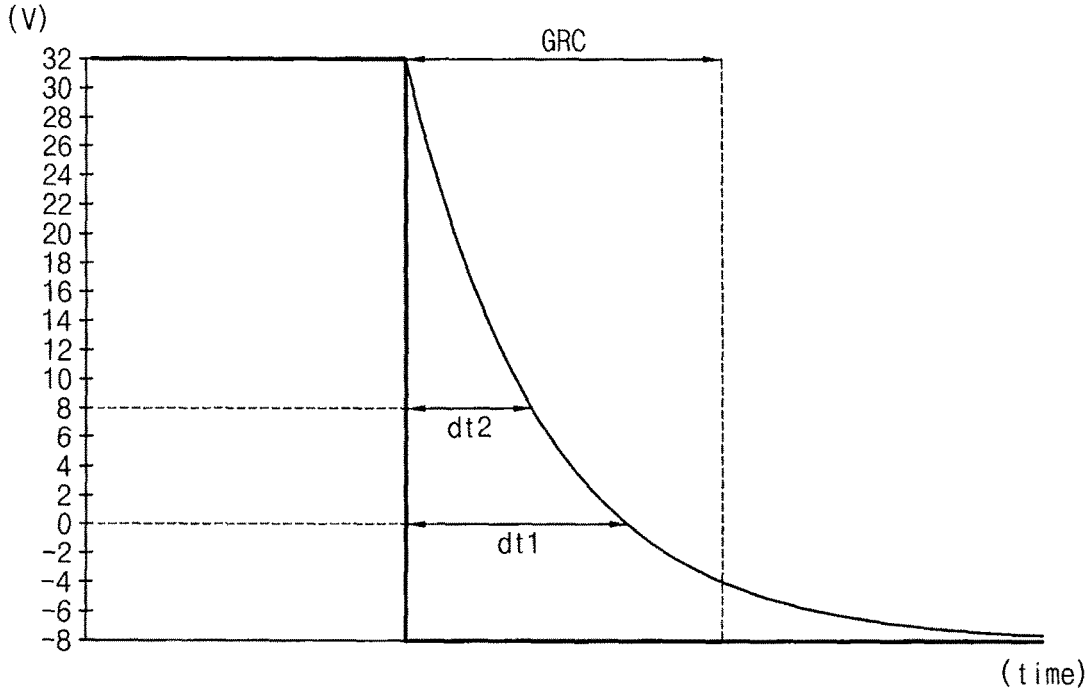
FIG. 5 is a graph illustrating set-up of a control time of an output enable signal and a predetermined time which is a difference of output timings of data signals according to an exemplary embodiment of the inventive concept.

FIG. 5 is a graph illustrating set-up of a control time of an output enable signal and a predetermined time which is a difference of output timings of data signals.

Referring to FIG. 5, the graph has an x-axis which means time, and a y-axis which means voltage V. An ideal gate signal G and a delayed gate signal Gd are illustrated.

An RC delay value GRC of a gate signal may be calculated by a traditional method. A predetermined time (refers to Δt of FIG. 4B) which is a time interval of the positive polarity data signal (+) and the negative polarity data signal (−) may be set according to the RC delay value GRC, a reference voltage, a voltage range of a positive polarity data signal (+), and a voltage range of a negative polarity data signal (−).

In an embodiment, the predetermined time is proportional to the RC delay value GRC.

In addition, an output-enable control signal (refer to OE of FIG. 4B) may be set based on the negative polarity data signal (−), or based on the positive polarity data signal (+).

For example, when voltage range of the positive polarity data signal (+) is 8V to 15V and voltage range of the negative polarity data signal (−) is 0V to 7V, a control period of the output-enable control signal (refer to W of FIG. 4B) may be set to 0.7*RC delay value GRC=dt1 by calculating with reference to a reference time when the negative polarity data signal (−) is 0V (white for normally black mode).

In this example, 0.4*RC delay value GRC=dt2 may be calculated with reference to a reference time when the positive polarity data signal (+) is 8V (black for normally black mode). Thus, the positive polarity data signal (+) has more charging time as a difference between dt1 and dt2, is about 30% of the RC delay value GRC. In an embodiment, the difference between dt1 and dt2 is the same as the predetermined time.

Figure 6:
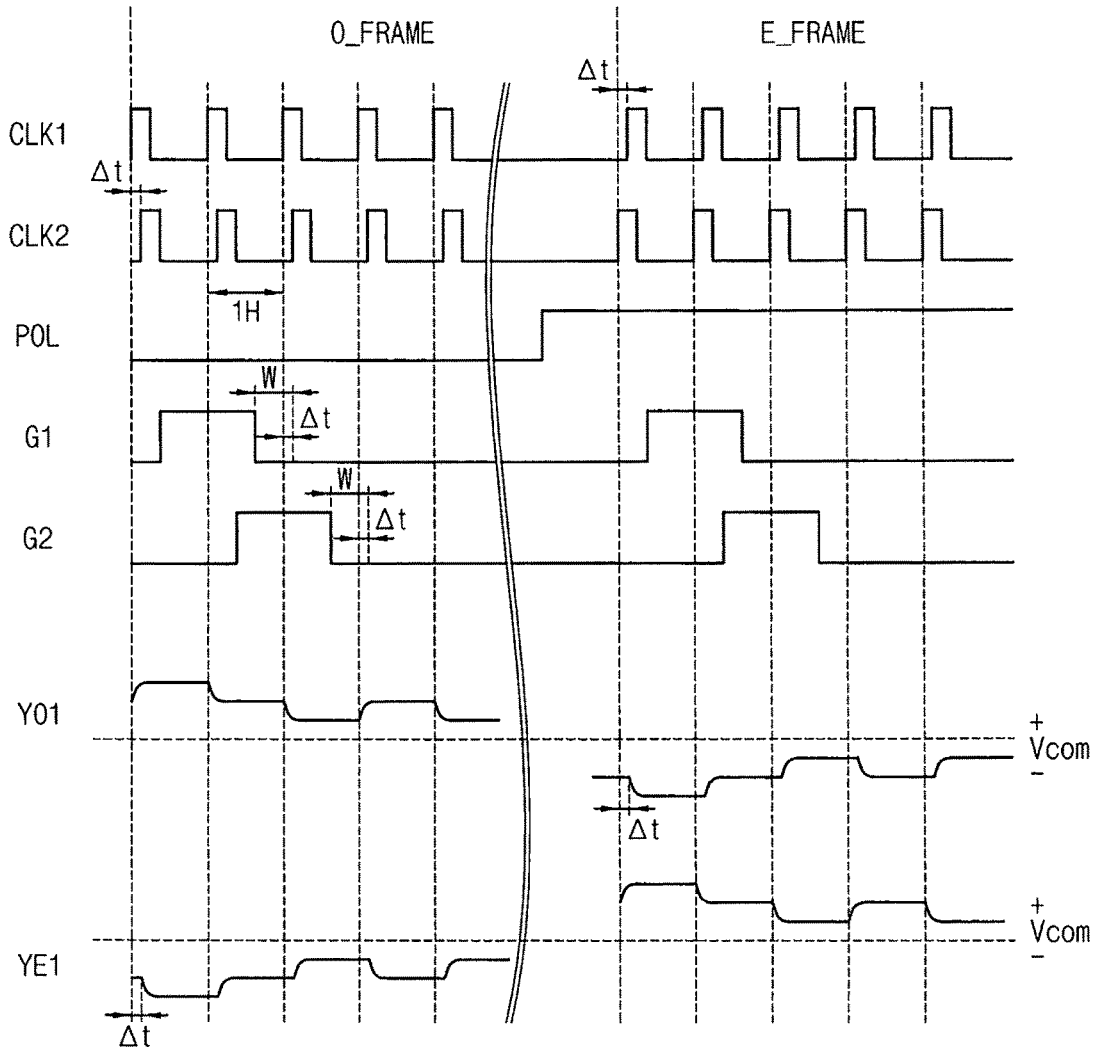
FIG. 6 is a waveform diagram illustrating signals of a display driving part according to an exemplary embodiment of the inventive concept.

FIG. 6 is a waveform diagram illustrating signals of a display driving part according to an exemplary embodiment of the inventive concept.

Referring to FIGS. 2 and 6, a data driving part 230 outputs the data signals YO1, YE1 based on the first clock signal CLK1, the second clock signal CLK2 and the polarity inversion signal POL from a control circuit part 210. Thus, odd-numbered data signal YO1 may be provided to odd-numbered data lines and even-numbered data signal YE1 may be provided to even-numbered data lines. The gate driving part 250 receives the gate control signal GCONT from a control circuit part 210 and outputs gate signals G1, G2. The display driving part may be driven by a column inversion mode and a frame inversion mode.

For convenience of explanation, only gate signals G1, G2 for first and second gate lines, and odd-numbered data signal YO1 and even-numbered data signal YE1 will be explained.

The first clock signal CLK1 may control a rising time, that is, a start timing of a rising period during which each of the odd-numbered data signals YO1 rise from a low level to a high level. Thus, the each of the data values which is included in the odd-numbered data signal YO1 may be outputted with reference to the first clock signal CLK1 every one horizontal period 1H.

In addition, although the data values are changed with reference to a rising edge of the first clock signal CLK1, the inventive concept is not limited thereto. For example, the data values of the odd-numbered data signal YO1 every one horizontal period 1H may be outputted in synchronization with a rising edge or a falling edge of the first clock signal CLK1.

The second clock signal CLK2 may control a rising time, that is, a start timing of a rising period during which the even-numbered data signal YE1 rises from a low level to a high level. Thus, each of the data values which is included in the even-numbered data signal YE1 may be outputted with reference to the second clock signal CLK2 every one horizontal period 1H.

In addition, although the data values are changed with reference to a rising edge of the second clock signal CLK2, the inventive concept is not limited thereto. For example, the data values of the even-numbered data signal YE1 every one horizontal period 1H may be outputted in synchronization with a rising edge or a falling edge of the second clock signal CLK2.

During an odd-numbered frame period O_FRAME, the second clock signal CLK2 follows the first clock signal CLK1 by a predetermined time Δt. For example, during part of an odd-numbered frame period O_FRAME, a pulse of the second clock signal CLK2 follows and partially overlaps a pulse of the first clock signal CLK1. In an embodiment, first pulses of the first clock signal CLK1 during the odd-numbered frame period O_FRAME are out of phase with first pulses of the second clock signal CLK2 during the odd-numbered frame period O_FRAME by a first angle. During an even-numbered frame period E_FRAME, the first clock signal CLK1 follows the second clock signal CLK2 by a predetermined time Δt. For example, during part of the even-numbered frame E_FRAME, a pulse of the first clock signal CLK1 follows and partially overlaps a pulse of the second clock signal CLK2. In an embodiment, second pulses of the first clock signal CLK1 during the even-numbered frame period E_FRAME are out of phase with second pulses of the second clock signal CLK2 during the even-numbered frame period E_FRAME by a second angle.

Thus, a clock signal (second clock signal CLK2 or first clock signal CLK1) which is synchronized to the data value which has a negative polarity follows a clock signal (first clock signal CLK1 or second clock signal CLK2) which is synchronized to the data value which has a positive polarity by the predetermined time Δt. Thus, a data signal which has a negative polarity value may be outputted next to a data signal which has positive polarity value by the predetermined time Δt.

The polarity inversion signal POL reverses the data signals YO1, YE1. For example, the polarity inversion signal POL may have a low level during the odd-numbered frame period O_FRAME, and have a high level during the even-numbered frame period E_FRAME. Accordingly, the odd-numbered data signal YO1 has data values which have different polarities in the odd-numbered frame period O_FRAME and the even-numbered frame period E_FRAME. The even-numbered data signal YE1 has data values which have different polarities in the odd-numbered frame period O_FRAME and the even-numbered frame period E_FRAME.

The gate driving part 250 may generate the gate signal G1, G2 which have a gate-on level and a gate-off level using a gate-on signal having a high level and a gate-off signal having a low level. Each of the gate signals G1, G2 may be provided to each of the first and second gate lines first during two horizontal periods 2H, in order. The falling timing of gate signals G1, G2 may be set by a control period W of an output enable control signal (e.g., refers to OE of FIG. 4B).

In an embodiment, the output enable control signal is set with reference to a negative polarity data signal, so that the control period W is set in consideration of the predetermined time Δt.

The odd-numbered data signal YO1 may have a positive (+) data value with reference to a reference signal VCOM during the odd-numbered frame period O_FRAME. The odd-numbered data signal YO1 may have a negative (−) data value with reference to the reference signal VCOM during the even-numbered frame period E_FRAME.

The even-numbered data signal YE1 may have a negative (−) data value with reference to the reference signal VCOM during the odd-numbered frame period O_FRAME. The even-numbered data signal YE1 may have a positive (+) data value with reference to the reference signal VCOM during the even-numbered frame period E_FRAME.

According to the present exemplary embodiment, a data signal having a negative data value follows a data signal having a positive data value by the predetermined time Δt, so that a positive data charging time is longer than a negative data charging time by the predetermined time Δt. Thus, display quality degradation due to charging ratio differences according to polarities may be reduced.

Figure 7:
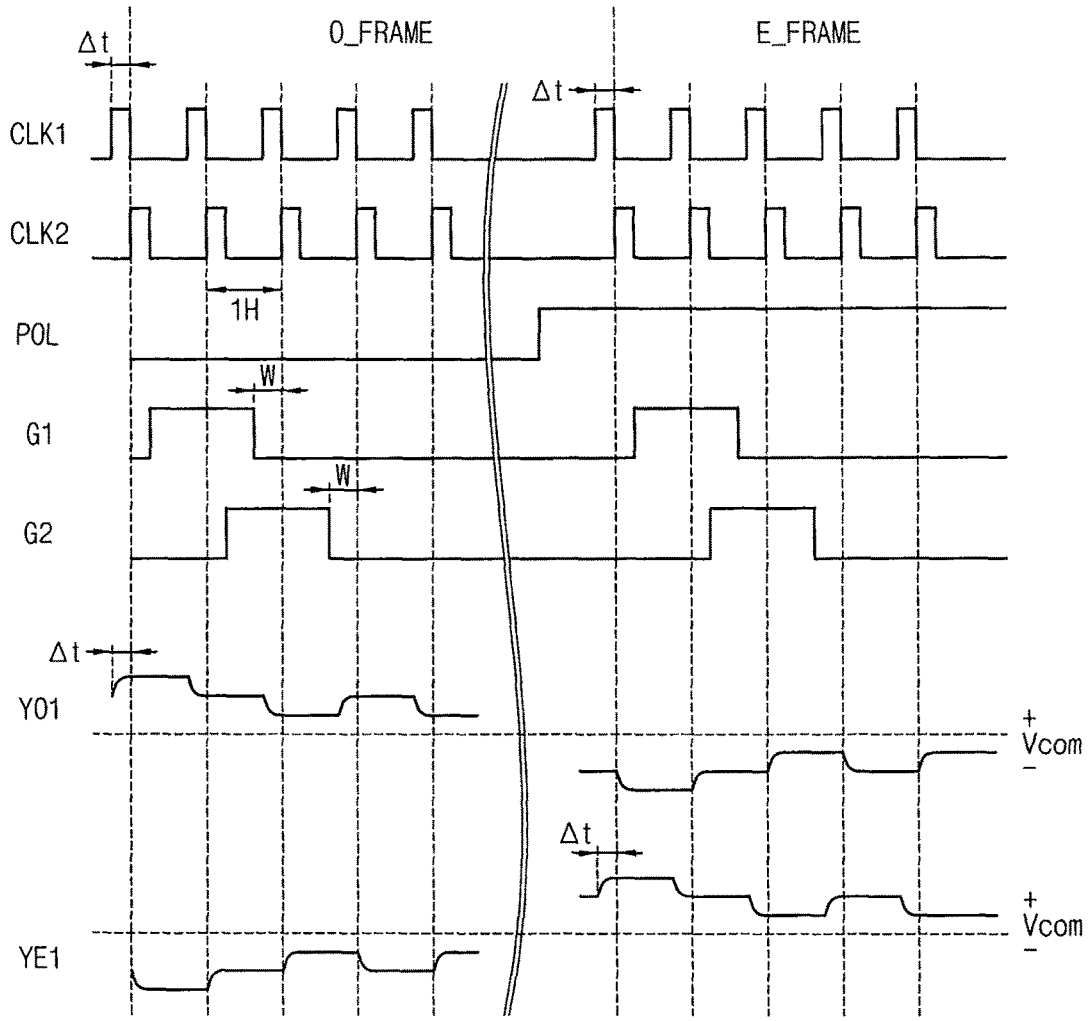
FIG. 7 is a waveform diagram illustrating signals of a display driving part according to an exemplary embodiment of the inventive concept.

FIG. 7 is a waveform diagram illustrating signals of a display driving part according to an exemplary embodiment of the inventive concept.

Referring to FIGS. 2 and 7, a data driving part 230 may output the data signals YO1, YE1 based on the first clock signal CLK1, the second clock signal CLK2 and the polarity inversion signal POL from a control circuit part 210. Thus, odd-numbered data signal YO1 may be provided to odd-numbered data lines and even-numbered data signal YE1 may be provided to even-numbered data lines. The gate driving part 250 may receive the gate control signal GCONT from the control circuit part 210 and output gate signals G1, G2. The display driving part may be driven by a column inversion mode and a frame inversion mode.

For convenience of explanation, only gate signals G1, G2 for first and second gate lines, and odd-numbered data signal YO1 and even-numbered data signal YE1 will be explained.

The first clock signal CLK1 precedes the second clock signal CLK2 by a predetermined time Δt. For example, pulses of the first clock signal CLK1 precede respective pulses of the second clock signal CLK2 in the odd-numbered frame period O_FRAME and the even-numbered frame period E_FRAME.

The first clock signal CLK1 may control output timing of data signal which includes positive polarity data values. The second clock signal CLK2 may control output timing of data signals which includes negative polarity data value.

For example, during an odd-numbered frame period O_FRAME, each of the data values of the odd-numbered data signal YO1 may be outputted with reference to the first clock signal CLK1 every one horizontal period 1H. In an embodiment, during the odd-numbered frame period O_FRAME, each of the data values of the even-numbered data signal YE1 are outputted with reference to the second clock signal CLK2 every one horizontal period 1H.

In addition, during an even-numbered frame period E_FRAME, each of the data values of the odd-numbered data signal YO1 may be outputted with reference to the second clock signal CLK2 every one horizontal period 1H. In an embodiment, during the even-numbered frame period E_FRAME, each of the data values of the even-numbered data signal YE1 is outputted with reference to the first clock signal CLK1 every one horizontal period 1H.

In addition, although the data values are changed with reference to a rising edge of the second clock signal CLK2, the inventive concept is not limited thereto. For example, the data values of the even-numbered data signal YE1 every one horizontal period 1H may be outputted in synchronization with a rising edge or a falling edge of the second clock signal CLK2.

The polarity inversion signal POL reverses the data signals YO1, YE1. For example, the polarity inversion signal POL may have a low level during the odd-numbered frame period O_FRAME, and have a high level during even-numbered frame period E_FRAME. Accordingly, the odd-numbered data signal YO1 may have data values which have different polarities in the odd-numbered frame period O_FRAME and the even-numbered frame period E_FRAME. The even-numbered data signal YE1 may have data values which have different polarities in the odd-numbered frame period O_FRAME and the even-numbered frame period E_FRAME.

In addition, the first and second clock signals CLK1, CLK2 may be synchronized to the odd or even-numbered data signal YO1, YE1 based on the polarity inversion signal POL. For example, during the odd-numbered frame period O_FRAME, when the polarity inversion signal POL has the low level, the first clock signal CLK1 is synchronized to the odd-numbered data signal YO1, and the second clock signal CLK2 is synchronized to the even-numbered data signal YE1. In addition, during the even-numbered frame period E_FRAME, when the polarity inversion signal POL has the high level, the first clock signal CLK1 is synchronized to the even-numbered data signal YE1, and the second clock signal CLK2 is synchronized to the odd-numbered data signal YO1.

The gate driving part 250 may generate the gate signal G1, G2 which have gate-on level and gate-off level using a gate-on signal having a high level and a gate-off signal having a low level. Each of the gate signals G1, G2 may be provided to each of the first and second gate lines first during two horizontal periods 2H, in order. The falling timing of gate signals G1, G2 may be set by a control period W of an output enable control signal (e.g., refer to OE of FIG. 4B).

The odd-numbered data signal YO1 may have a positive (+) data value with reference to a reference signal VCOM during the odd-numbered frame period O_FRAME. The odd-numbered data signal YO1 may have a negative (−) data value with reference to the reference signal VCOM during the even-numbered frame period E_FRAME.

The even-numbered data signal YE1 may have a negative (−) data value with reference to the reference signal VCOM during the odd-numbered frame period O_FRAME. The even-numbered data signal YE1 may have a positive (+) data value with reference to the reference signal VCOM during the even-numbered frame period E_FRAME.

According to the present exemplary embodiment, a data signal having the negative data value follows a data signal having a positive data value by the predetermined time Δt, so that positive data charging time is longer than negative data charging time by the predetermined time Δt. Thus, display quality degradation due to charging ratio differences according to polarities may be reduced.

According to exemplary embodiments of the present inventive concept, output timing of positive polarity data signals and output timing of negative polarity data signals may be different from each other, so that display quality degradation due to charging ratio differences between positive and negative polarities according to an RC delay of a scan signal (e.g., a gate signal) may be reduced.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the inventive concept. Accordingly, all such modifications are intended to be included within the scope of the inventive concept.

What is claimed is:

1. A method of driving a display panel of a display apparatus, the method comprising:

outputting, by a control circuit, a data signal, a first clock signal, a second clock signal, and a polarity inversion signal;

providing, by a data driver of the display apparatus, a first positive polarity data signal to a first data line of the display panel during a first frame and preceding the first frame based on the data signal, the first clock signal and the polarity inversion signal, the first positive polarity data signal having a first polarity; and providing, by the data driver, a first negative polarity data signal to a second data line of the display panel during the first frame based on the data signal, the second clock signal, and the polarity inversion signal, the first negative polarity data signal having a second polarity; and providing, by the data driver, a second negative polarity data signal having the second polarity to the first data line during a second frame without preceding the second frame based on the data signal, the first clock signal and the polarity inversion signal, wherein output timing of the first positive polarity data signal is different from output timing of the first negative polarity data signal such that times at which the first positive and negative polarity data signals begin to be output from the data driver differ from one another.

2. The method of claim 1, wherein the output timing of the first positive polarity data signal precedes the output timing of the first negative polarity data signal by a predetermined period.

3. The method of claim 2, further comprising:

providing, by the data driver, a second positive polarity data signal having the first polarity to the second data line during the second frame and preceding the second frame, wherein the second positive polarity data signal is based on the data signal, the second clock signal, and the polarity inversion signal.

4. The method of claim 2, wherein the predetermined time period is shorter than one horizontal period.

5. The method of claim 2, wherein the predetermined time period is set to be proportional to an RC delay time period of a gate signal.

6. The method of claim 5, wherein the predetermined time period is about 30% of an RC delay time period of a gate signal.

7. The method of claim 3, wherein the first clock signal and the second clock signal have rising times different from each other.

8. The method of claim 7, wherein the first clock signal controls the output timing of the first positive polarity data signal and the first negative polarity data signal, and the second clock signal controls the output timing of the second negative polarity data signal and the second positive polarity data signal.

9. The method of claim 8, wherein the polarity inversion signal has a first logic level to set a polarity of the first positive polarity data signal and the first negative polarity data signal during the first frame, and the polarity inversion signal has a second logic level to set a polarity of the second positive polarity data signal and the second negative polarity data signal during the second frame, wherein the first and second logic levels differ from one another.

10. A display apparatus comprising:

a display panel comprising a plurality of data lines, a plurality of gate lines and a plurality of pixels, each of the pixels comprising a switching element electrically connected to a corresponding one of the gate lines and a corresponding one of the data lines;

a control circuit configured to output a data signal, a first clock signal, a second clock signal, and a polarity inversion signal;

a data driver configured to provide a first positive polarity data signal having a first polarity to a first data line among the data lines during a first frame and preceding the first frame based on the data signal the first clock signal and the polarity inversion signal, a first negative polarity data signal having a second polarity to a second data line among the data lines during the first frame based on the data signal, the second clock signal, and the polarity inversion signal, and provide a second negative polarity data signal having the second polarity to the first data line during a second frame without preceding the second frame based on the data signal, the first clock signal and the polarity inversion signal, wherein output timing of the first positive polarity data signal is different from output timing of the first negative polarity data signal such that times at which the first positive and negative polarity data signals begin to be output from the data driver differ from one another.

11. The display apparatus of claim 10, wherein the output timing of the first positive polarity data signal precedes the output timing of the first negative polarity data signal by a predetermined time period.

12. The display apparatus of claim 11, wherein the data driver provides a second positive polarity data signal having the first polarity to the second data line during and preceding the second frame, and wherein the second positive polarity data signal is based on the data signal, the second clock signal and the polarity inversion signal.

13. The display apparatus of claim 12, wherein the first and second data lines are adjacent one another.

14. The display apparatus of claim 12, wherein the second clock signal has a rising edge different from that of the first clock signal.

15. The display apparatus of claim 14, wherein the data driver is configured to control output timing of the first positive polarity data signal and the first negative polarity signal using the first clock signal, and configured to control output timing of the second negative polarity data signal and the second positive polarity data signal using a second clock signal.

16. The display apparatus of claim 15, wherein the polarity inversion signal has a first logic level to set a polarity of the first positive polarity data signal and the first negative polarity data signal during the first frame, and the polarity inversion signal has a second logic level to set a polarity of the second positive polarity data signal and the second negative polarity data signal during the second frame, wherein the first and second logic levels differ from one another.

17. The display apparatus of claim 11, wherein the predetermined time period is shorter than one horizontal period.

18. The display apparatus of claim 11, wherein the predetermined time period is set to be proportional to an RC delay time period of a gate signal.

19. The display apparatus of claim 18, wherein the predetermined period is about 30% of an RC delay time period of a gate signal.

20. A driving apparatus for a display panel of a display apparatus, the driving apparatus comprising:

a controller circuit configured to output a first clock signal with a first timing and a second clock signal with a second different timing such that a second edge of the second clock signal is delayed by a period of time relative to a first edge of the first clock signal, the controller circuit further configured to output a data signal and polarity inversion signal; and a data driving circuit configured to provide a positive polarity data signal having a first polarity to a first data line of the display panel during a first frame in response to the first edge of the first clock signal based on the data signal and the polarity inversion signal, and provide a negative polarity data signal having a second polarity to a second adjacent data line of the display panel during the first frame in response to the second edge of the second clock signal based on the data signal and the polarity inversion signal, wherein a first pulse of the first clock signal precedes the first frame and a second pulse of the first clock signal starts when a second frame starts without preceding the second frame.

21. The driving apparatus of claim 20, wherein pulses of the second clock signal follow respective pulses of the first clock signal without overlap during an odd-numbered frame period, and pulses of the second clock signal precede respective pulses of the first clock signal without overlap during an even-numbered frame period.

22. The driving apparatus of claim 20, wherein pulses of the second clock signal follow respective pulses of the first clock signal with overlap during an odd-numbered frame period, and pulses of the second clock signal precede respective pulses of the first clock signal with overlap during an even-numbered frame.

23. The driving apparatus of claim 20, wherein pulses of the second clock signal follow respective pulses of the first clock signal without overlap.

24. The driving apparatus of claim 20, wherein the polarity inversion signal has a first logic level to set a polarity of the positive polarity data signal and the negative polarity data signal during the first frame, and the polarity inversion signal has a second logic level to set a polarity of the positive polarity data signal and the negative polarity data signal during the second frame, wherein the first and second logic levels differ from one another.

* * * * *